US010245192B2

(12) United States Patent
Burkeen

(10) Patent No.: US 10,245,192 B2
(45) Date of Patent: Apr. 2, 2019

(54) EXTENDABLE AND RETRACTABLE GURNEY

(71) Applicant: Bobby Allan Burkeen, Carlsbad, NM (US)

(72) Inventor: Bobby Allan Burkeen, Carlsbad, NM (US)

( * ) Notice: Subject to any disclaimer, the term of this patent is extended or adjusted under 35 U.S.C. 154(b) by 566 days.

(21) Appl. No.: 15/097,699

(22) Filed: Apr. 13, 2016

(65) Prior Publication Data

US 2017/0296404 A1 Oct. 19, 2017

(51) Int. Cl.

| | |
|---|---|
| ***A61G 3/02*** | (2006.01) |
| ***A61G 1/06*** | (2006.01) |
| ***A61G 3/08*** | (2006.01) |

(52) U.S. Cl.

CPC ..... *A61G 3/0254* (2013.01); *A61G 1/06* (2013.01); *A61G 3/0825* (2013.01); *A61G 3/0891* (2013.01)

(58) Field of Classification Search

CPC ..... A61G 1/06; A61G 3/02; A61G 3/0218; A61G 3/0245; A61G 3/0254; A61G 3/0272; A61G 3/0816; A61G 3/0825; A61G 3/0833; A61G 3/085; A61G 3/0875; A61G 3/0883; A61G 3/0891; B60P 1/52; B60R 5/041

See application file for complete search history.

(56) References Cited

U.S. PATENT DOCUMENTS

| | | | | |
|---|---|---|---|---|
| 2,643,395 | A | 6/1953 | Stassinos | |
| 3,006,487 | A | 10/1961 | Gelli | |
| 3,406,849 | A * | 10/1968 | Warren | B60P 1/52 193/35 R |
| 3,831,996 | A | 8/1974 | Layers | |
| 4,950,123 | A | 8/1990 | Brockhaus | |
| 6,024,528 | A | 2/2000 | Taylor | |
| 6,332,638 | B1 * | 12/2001 | Menna | A61G 1/0565 296/20 |
| 7,237,667 | B2 * | 7/2007 | Marcelli | B60P 1/52 193/35 SS |

(Continued)

FOREIGN PATENT DOCUMENTS

| | | |
|---|---|---|
| AU | 2008216990 | 10/2007 |
| DE | 578863 | 7/1933 |

(Continued)

*Primary Examiner* — Nicholas F Polito

(74) *Attorney, Agent, or Firm* — Shaukat A. Karjeker; Carstens & Cahoon, LLP

(57) ABSTRACT

There is provided an extendable and retractable gurney mountable to a rescue vehicle and configured to receive and hold a rescue basket thereon. The gurney has a base for fixed mounting to a floor area of the rescue vehicle. The gurney has a rescue basket cradle that slides (relative to the base) outward from a stowed configuration on a rescue vehicle to an extended configuration to receive a rescue basket, and then moves back inward to a stowed configuration in the emergency vehicle. Rollers are arrayed along a side of a longitudinally extending slat to facilitate rolling contact with an underside of a rescue basket, when it is placed on the cradle, thereby allowing the basket to be readily moved into appropriate position on the cradle for securing it to, and immobilizing it on, the gurney.

20 Claims, 9 Drawing Sheets

(56) References Cited

U.S. PATENT DOCUMENTS

| | | | | |
|---|---|---|---|---|
| 7,802,958 | B2 * | 9/2010 | Garcia | B60P 1/52 414/482 |
| 8,104,814 | B2 | 1/2012 | Markus | |
| 2009/0015027 | A1 * | 1/2009 | Lambarth | A61G 1/0212 296/20 |
| 2013/0149085 | A1 * | 6/2013 | Bourgraf | B60P 1/003 414/477 |
| 2015/0297427 | A1 * | 10/2015 | Lambarth | A61G 1/02 414/525.1 |

FOREIGN PATENT DOCUMENTS

| | | |
|---|---|---|
| DE | 102011078803 | 1/2013 |
| GB | 2405852 | 9/2003 |
| GB | 2467524 | 1/2009 |
| WO | 1990004377 | 5/1990 |
| WO | 1991015178 | 3/1991 |

* cited by examiner

EXTENDABLE AND RETRACTABLE GURNEY

BACKGROUND

1. Field of the Invention

The invention relates to gurneys used in connection with a rescue basket to effect rescue of an injured person, and more particularly provides a gurney that is mounted to a rescue vehicle from where it is readily moved to an extended configuration, when a rescue basket with an injured person is placed upon it, then moved to a stowed configuration for transport of the injured person on the rescue basket.

2. Description of the Related Art

The need to rescue injured persons or persons in peril appears to grow annually as people venture out and undertake activities that present recreational opportunities that also carry a risk of injury. During rescue operations, especially in hazardous terrain, but also in circumstances where the injured person must be restrained to avoid risk of further injury from handling during rescue, the injured person may be immobilized on a rescue basket. These baskets are often of a standard size and shape, and have open hand grips along the sides for lifting the basket, and for attaching tethers to lift the basket, such as in an air lift operation. The hand grips can also be used with straps, bungee cords, or the like to secure the injured person to the basket and to immobilize him or her to limit any further injury.

Once the injured party is secured to the rescue basket, the rescue basket must be loaded to a rescue vehicle of some kind, for example an ambulance, a back of a 4 wheel drive or other truck, or a helicopter, and the like. It is during these further operations that additional potential risks are presented in the activities of lifting and securing the injured person on the vehicle for safe transport. The nature of the terrain (for example, slippery and/or rocky) may present hazards to the rescuers and pose a risk of dropping the rescue basket, and the nature of the injured person (for example, large, heavy) may also present risks of dropping the rescue basket while lifting it into the rescue vehicle.

SUMMARY

The following is a summary providing some of the features of the retractable and extendable gurney, and is not limiting of the inventions herein. More features and advantages will become apparent from the detailed description here below, and the attached drawings.

In an exemplary embodiment there is provided an extendable and retractable gurney that is mountable to a rescue vehicle and configured to receive and hold a rescue basket thereon. The extendable and retractable gurney has a rescue basket support frame that moves outward from a stowed configuration on a rescue vehicle for a rescue basket to be set thereon and rolled into position on the gurney, which then moves inward to a stowed configuration in the emergency vehicle for transport of the rescued person on the rescue basket. The exemplary retractable gurney has a base that includes a base frame configured for mounting to a floor area of the rescue vehicle. There is a longitudinal slider bracket fixedly mounted to the base frame, and a slider operatively engaged with and sliding relative to the longitudinal slider bracket, from a stowed position to an extended position. A rescue basket support frame is mounted to and above the base. The rescue basket support frame has a rescue basket cradle configured to support an end and sides of a rescue basket. The rescue basket cradle includes a pair of parallel spaced apart longitudinal rescue basket side supports joined at a proximal end by a rescue basket end support. A longitudinally extending slat is mounted at a lower elevation than, and extends inboard from, the pair of spaced apart longitudinal basket side supports. A series of rollers are arrayed alongside the longitudinally extending slat and the rollers extend at least partially above the upper surface of the slat to facilitate rolling contact between the series of rollers and an underside of a rescue basket, when it is placed on the slat, in order to facilitate moving the rescue basket longitudinally. In addition, there is a plurality of convex-downward cross beams, configured to support the frame when it receives a rescue basket thereon. These convex-downward cross beams extend laterally between the pair of spaced apart longitudinal basket side supports and are mounted in fixed mechanical relation to the slider such that the rescue basket support frame slides along with the slider. Thus, the extendable and retractable gurney has a rescue basket support frame that moves outward from a stowed configuration on a rescue vehicle to receive a rescue basket, and then moves inward to a stowed configuration in the emergency vehicle for transport of the rescued person on the rescue basket.

Optionally, the exemplary extendable and retractable gurney has a longitudinal stop lever with a spring loaded handle at the distal end. The stop lever prevents the slider from disengaging from the slider bracket, when the gurney is extended, and the lever is in an engaged position. The stop lever can also be placed in a locked position when the gurney is retracted to a stowed configuration, to lock the rescue basket frame in the stowed configuration.

Optionally, the stop lever is mounted to the rescue basket support frame and the base includes a bracket engaging an opposite end of the stop lever, when it is in an engaged position.

Optionally, the exemplary extendable and retractable gurney has a basket clamp, the basket clamp engages an end portion of a frame of the rescue basket, when placed on the gurney, to lock the rescue basket in place on the rescue basket cradle. Optionally, the basket clamp is spring loaded and has a locking mechanism to secure the rescue basket.

Optionally, the extendable and retractable gurney further includes a hand grip at the distal end of each of the parallel spaced apart longitudinal rescue basket longitudinal side supports.

Optionally, the extendable and retractable gurney of has a second slat parallel to the longitudinally extending slat. The second slat has a series of rollers arrayed along its side and the rollers extend at least partially above an upper surface of the second slat.

There is provided an extendable and retractable gurney mountable to a rescue vehicle and configured to receive and hold a rescue basket thereon. The exemplary embodiment of the gurney has a base for fixed mounting to a floor area of the rescue vehicle. The gurney has a rescue basket cradle that slides (relative to the base) outward from a stowed configuration on a rescue vehicle to an extended configuration to receive a rescue basket, and then moves back inward to a stowed configuration in the emergency vehicle. The "extendable and retractable" feature of the gurney reduces risks during the necessary handling of the injured-party-laden rescue basket to transfer it into a rescue vehicle, as compared to gurneys that lack this feature. Rollers are arrayed in the rescue basket cradle portion of the gurney to facilitate rolling contact with an underside of a rescue basket, when it is placed on the cradle, thereby allowing the rescue basket to be readily moved into appropriate position on the cradle for securing it to, and immobilizing it on, the gurney. These rollers also reduce risks as compared to setting manually absent rollers. Hand grips may be provided on the rescue basket cradle to facilitate the rescuers in extending and retracting the sliding rescue basket cradle.

BRIEF DESCRIPTION OF THE DRAWINGS

The foregoing aspects and many of the attendant advantages, of the present technology will become more readily appreciated by reference to the following Detailed Description, when taken in conjunction with the accompanying simplified drawings of exemplary embodiments. The drawings, briefly described here below, are not to scale, are presented for ease of explanation and do not limit the scope of the inventions recited in the accompanying patent claims.

DETAILED DESCRIPTION OF EXEMPLARY EMBODIMENTS

Figure 1:
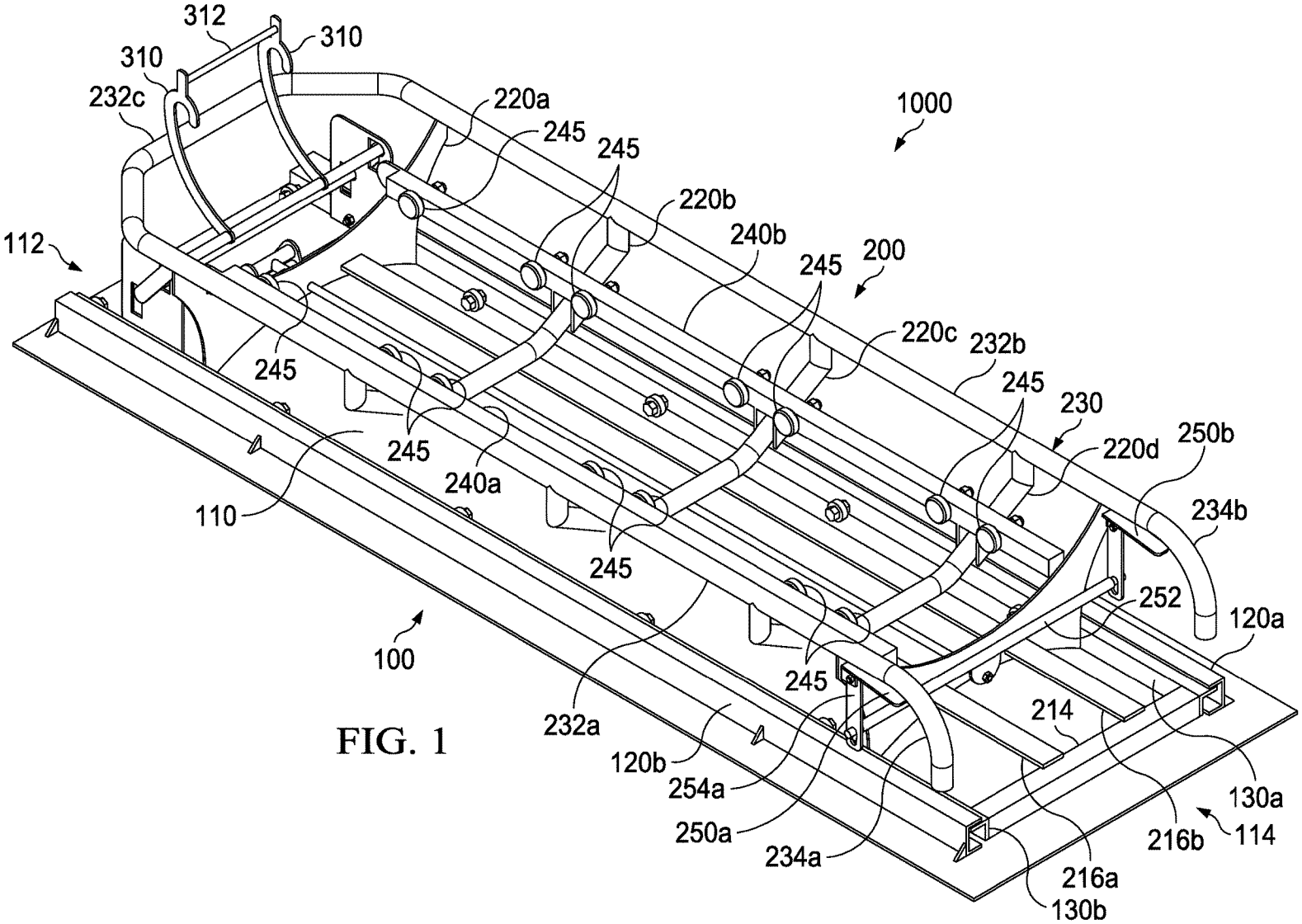
FIG. 1 is a perspective view of an exemplary embodiment of an extendable and retractable gurney, in stowed (also referred to as "retracted") configuration, in accordance with the invention.

The following non-limiting detailed descriptions of examples of embodiments of the invention may refer to appended Figure drawings and are not limited to the drawings, which are merely presented for enhancing explanations of features of the technology. In addition, the detailed descriptions may refer to particular terms of art, some of which are defined herein, as appropriate and necessary for clarity.

The term "inboard" as used herein to refer to location of a first feature of the extendable and retractable gurney relative to a second feature means that the first feature is located closer to a longitudinal central axis of the extendable and retractable gurney than the second feature. Correspondingly, the term "outboard" as used herein to refer to location of a first feature of the extendable and retractable gurney relative to a second feature means that the first feature is farther from a longitudinal central axis of the extendable and retractable gurney than the second feature.

The term "distal" as used herein refers to an end of the extendable and retractable gurney or rescue basket which is intended to be proximate the legs and feet of a person being rescued. The term "proximal as used herein refers to an end of the extendable and retractable gurney or rescue basket which is intended to be proximate the head of the person being rescued.

The term "sliding" as used herein means motion of one component relative to another component and that motion might be assisted by rollers. Therefore, "sliding engagement" of one component with another may include rollers that facilitate the sliding movement.

The term "convex-downward" in reference to crossbeams means that the cross beams are curved from end to end so as to curve downward from one end and then curve upward to the other end, as seen relative to the extendable and retractable gurney, when it is in a horizontal orientation.

In an exemplary embodiment there is provided an extendable and retractable gurney mountable to a rescue vehicle and configured to receive and hold a rescue basket thereon. The gurney is especially useful in rough or difficult terrain, but can be used in ordinary urban environments as well. The extendable and retractable gurney has a base for fixed mounting to a floor area of the rescue vehicle. The extendable and retractable gurney has a rescue basket cradle that slides (relative to the base) outward from a stowed configuration on a rescue vehicle to an extended configuration where it is locked in place to safely receive a rescue basket. The rescue basket is loaded onto the rescue basket cradle, and can be maneuvered into position on the cradle by sliding it into position on rollers that are arrayed to facilitate rolling contact with an underside of a rescue basket, when it is placed on the rescue basket cradle. Once the rescue basket is in position, it can be clamped immovably to the rescue basket cradle. The extendable and retractable gurney is then unlocked from the extended configuration and the cradle, with rescue basket thereon, is slid back inward to a stowed configuration in the emergency vehicle. The vehicle can then take the injured person ("rescuee") to an appropriate facility.

Figure 2:
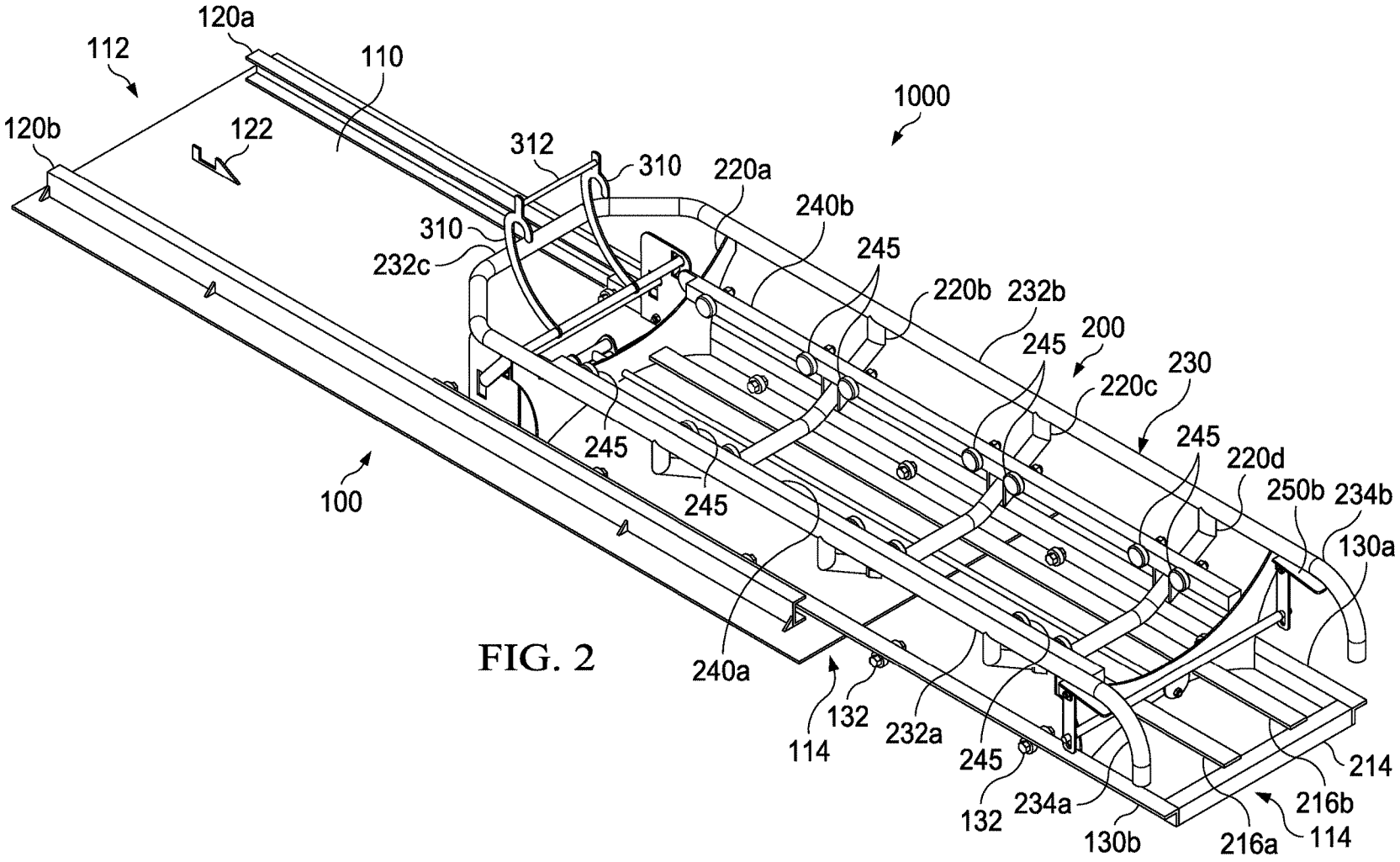
FIG. 2 is a perspective view of the exemplary embodiment of FIG. 1 depicting the extendable and retractable gurney, in extended configuration, in accordance with the invention.
Figure 3:
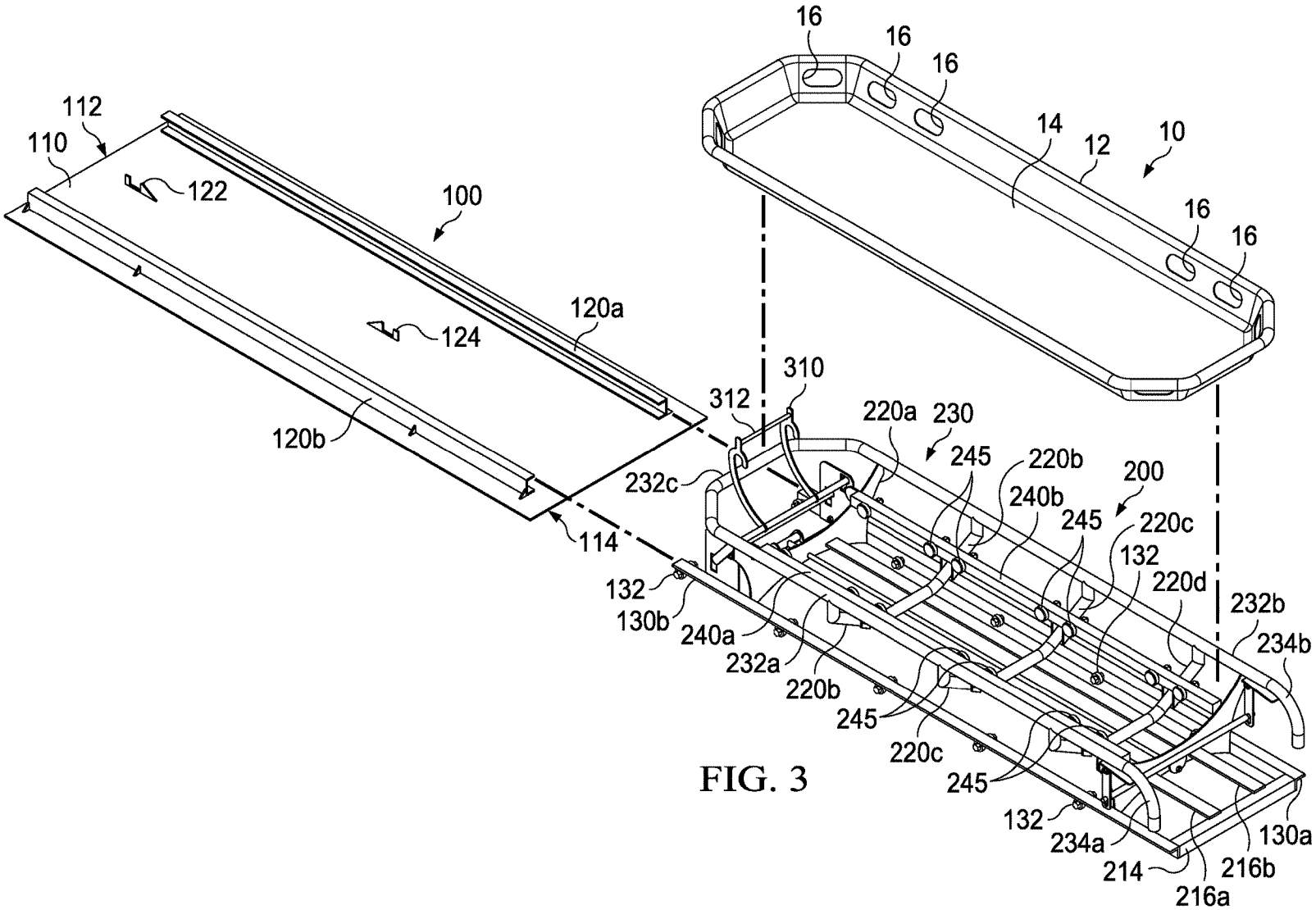
FIG. 3 is an exploded view of the exemplary embodiment of FIGS. 1 and 2, also showing a rescue basket to illustrate how it fits onto the gurney.

An exemplary embodiment of the extendable and retractable gurney 1000 is illustrated in FIGS. 1-3. FIG. 1 shows the exemplary extendable and retractable gurney in stowed configuration; FIG. 2 shows it in extended configuration. Details of the mechanical components are readily seen in the expanded view of FIG. 3, which also shows a rescue basket 10 as an aid to visualization.

Figure 4:
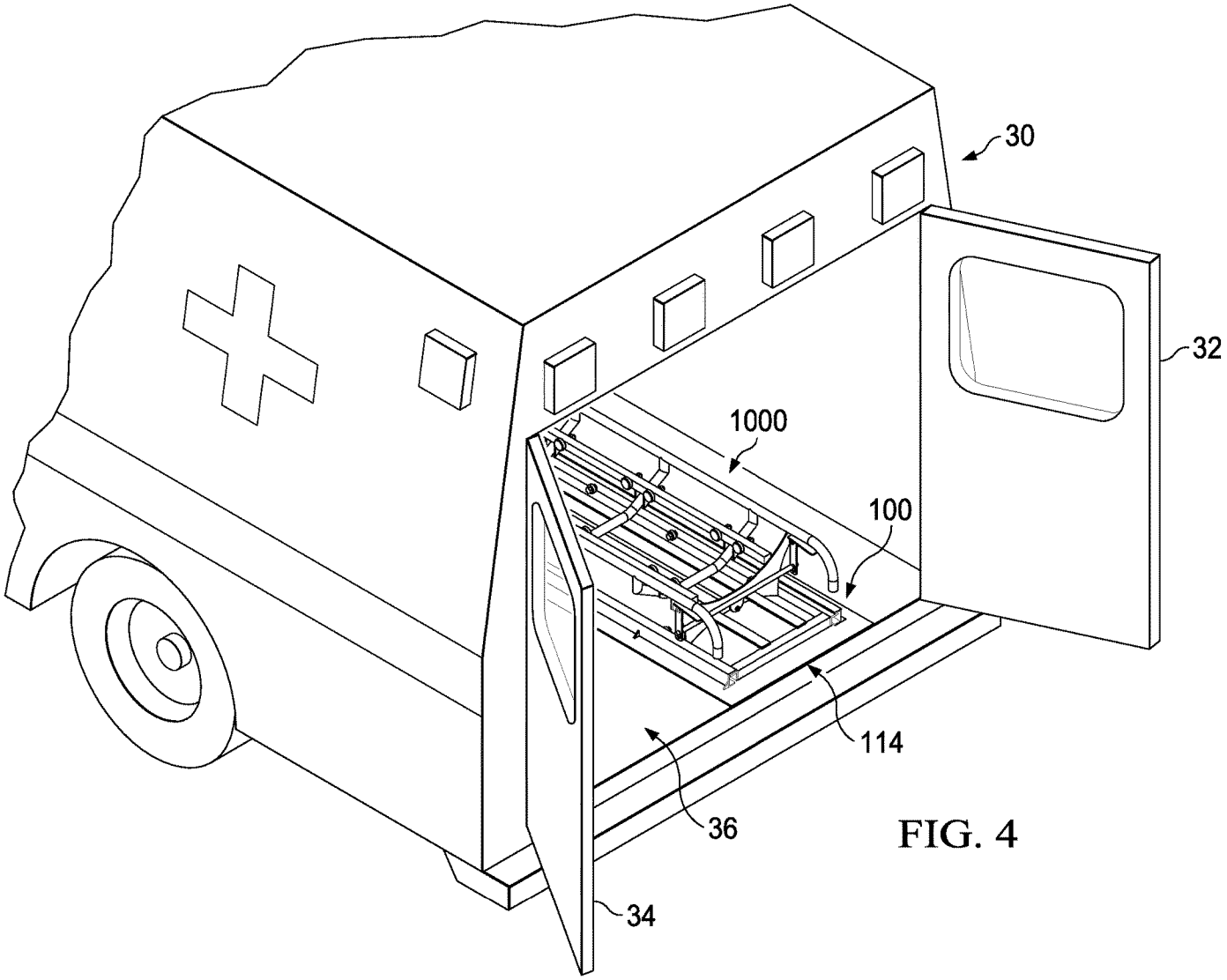
FIG. 4 is a partial perspective view showing the exemplary embodiment of the extendable and retractable gurney, in stowed (also referred to as "retracted") configuration in an emergency vehicle exemplified by an ambulance.

Referring to FIGS. 1-3, and especially to FIG. 3, the exemplary extendable and retractable gurney 1000 has a base section 100 with a base 100, exemplified as planar and rectangular, that has a proximal end 112 and a distal end 114. The base 100 can be mechanically affixed to the floor 36 of a rescue vehicle 30, as illustrated in FIG. 4. Of course, the rescue vehicle may be an ambulance, an SUV, a pickup truck, or another convenient conveyance; or even a helicopter adapted for rescue operations. The distal end 114 of the extendable and retractable gurney is proximate the doors 32, 34 of the exemplary rescue vehicle.

Referring again to FIG. 3, parallel spaced apart slider brackets 120*a* and 120*b* are fixedly mounted to the base 100 and extend lengthwise along the base 100. The slidable (extendable and retractable relative to the base 100) rescue basket support cradle 200 engages with and slides relative to these slider brackets. In the illustrated exemplary embodiments, the rescue basket support cradle 200 includes a pair of longitudinal, parallel, spaced apart sliders 130*a* and 130*b* that respectively engage and slide relative to slider brackets 120*a* and 120*b*. While the illustrated example shows angle iron sliders engaged and sliding within channel iron slider brackets, other configurations are also possible and useful. In addition the sliders 130*a* and 130*b* each include a series of outboard mounted rollers 132 that facilitate sliding by rolling contact with the slider brackets 120*a* and 120*b*. The use of rollers minimizes friction and reduces the force required to slide the sliders 130*a*, 130*b* in the slider brackets 120*a*, 120*b*, especially when a rescue in a rescue basket imposes a load on top of the rescue basket support 200.

Several crossbeams, such as crossbeam 214, extend laterally between the sliders 130*a*, 130*b* to maintain the sliders in parallel orientation relative to each other, and to provide structural support. There is preferably another cross beam at the distal end and one near the center of the sliders, but not visible due to being blocked from view by other components. These crossbeams are exemplified as channel iron, but other types of material and more (or fewer) can be used that perform the same function. Two cradle longitudinal cradle support beams 216*a* and 216*b* extend along the top of the crossbeams, exemplified by crossbeam 214, and are affixed to these crossbeams. A plurality of convex-downward crossbeams 220*a*, 220*b*, 220*c*, and 220*d* are fixedly mounted to the longitudinal cradle support beams 216*a* and 216*b*. A U-shaped shaped frame 230 is mounted to the rescue basket cradle 200 to extend along the upper ends of the convex-downward crossbeams 220*a*, 220*b*, 220*c*, and 220*d*. Thus the U-shaped frame has parallel side support railings 232*a* and 232*b*, joined at the proximal end by end support railing 232*c*. Distal ends of the side support railings 232*a* and 232*b* each terminate in a handle (234*a*, 234*b*, respectively) configured for grasping by hand to manually pull or push in order to slide the rescue basket support cradle 200 relative to the fixed base 100.

A pair of spaced apart longitudinal parallel slats 240*a*, 240*b* is fixedly mounted to the convex-downward crossbeams 220*a*, 220*b*, 220*c* and 220*d*, inboard of the side railings 232*a*, 232*b*. Of course, more than two slats may also be used. These slats 240*a*, 240*b* each have a series of rollers 245 mounted to them such that a portion of the roller extends above the upper surface of the slat. Thus, as will be apparent, when a rescue basket 10 is manipulated by its hand holds 16 and peripheral rail 12 onto the rescue cradle support structure, the base 14 of the basket 10 contacts the rollers 245 such that a person can easily slide the rescue basket 10 longitudinally on the cradle 200 to the desired position, for clamping the basket 10 in place on the extendable and retractable gurney, for example.

Figure 8:
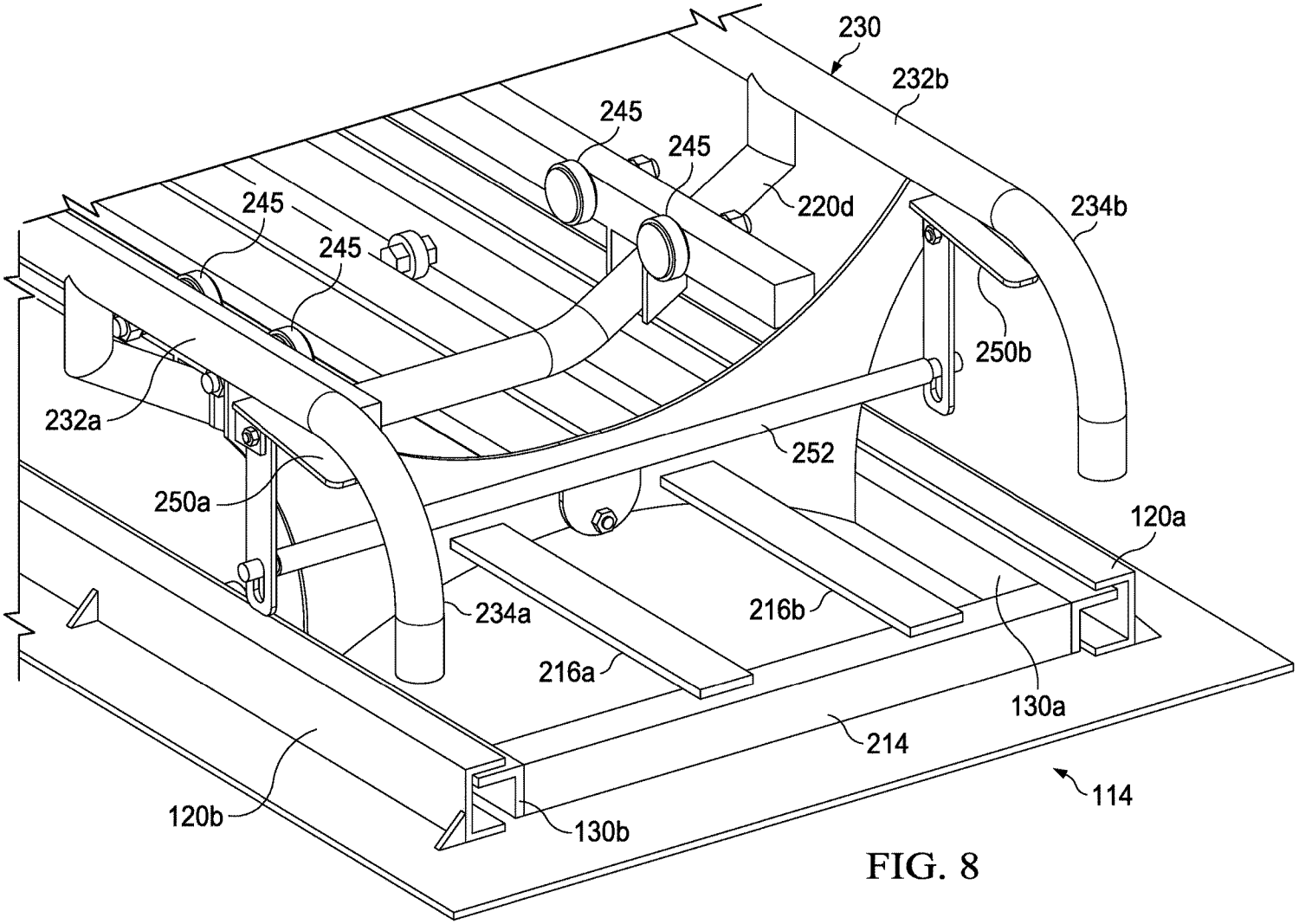
FIG. 8 is a perspective view of an exemplary embodiment of a hand activated locking mechanism located at a distal end of the extendable and retractable gurney.
Figure 9:
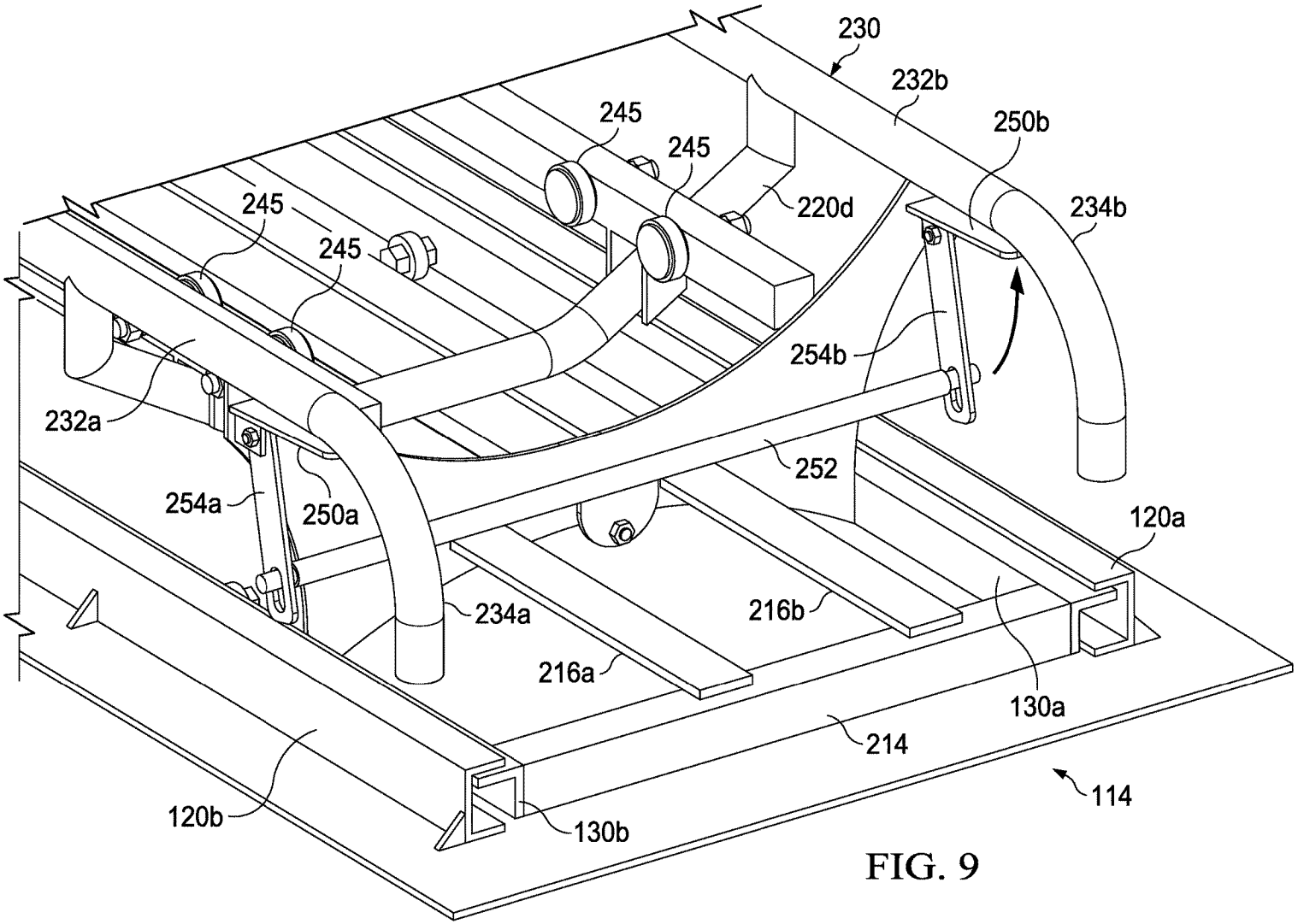
FIG. 9 is another perspective view of the exemplary embodiment of FIG. 8 showing the hand activated locking mechanism and depicting a levering action to unlock the locking mechanism.

The extendable and retractable gurney has a locking mechanism that holds the rescue basket support cradle 200 immobilized relative to the base. For example, it would be undesirable to have the support cradle slide about when the gurney is stowed in the rescue vehicle, and it would also be undesirable for it to slide when a rescue basket is being manipulated onto the gurney when it is in extended configuration. The exemplary embodiment illustrates a hand lever having a pair of hand grips 250*a*, 250*b*, at the distal end of the gurney, and having operatively coupled thereto a longitudinally extending lever (not shown). As perhaps seen more clearly from FIG. 3, and FIGS. 8-9, a proximal end 320 of the longitudinally extending lever operated by hand grips 250*a*, 250*b* has a rod 302 that engages either stop 122 (stowed configuration) or stop 124 (extended configuration), where both 122 and 124 are fixed to base 100. (see, FIG. 6) While not illustrated, the hand grips 250*a*, 250*b* could be provided with a (compression) spring, for example, to hold them in a position shown in FIG. 8 (lever locked to the stops). Upon then using one hand on each side, and lifting hand grips 250*a*, 250*b*, toward gurney handles 234*a*, 234*b*, a lateral tie rod 252 interconnecting the hand grips via brackets 254*a*, 254*b*, respectively, operates the longitudinally extending lever to engage or disengage from the stops 122 or 124. Thus, locking or disengaging the extendable and retractable gurney in or from either stowed or extended configuration.

The distal location of the hand grips 250*a*, 250*b* close to handles 234*a*, 234*b* is advantageous in allowing a rescuer ready access to manually locking and unlocking the extendable and retractable gurney in a desired configuration: stowed or extended.

Figure 5:
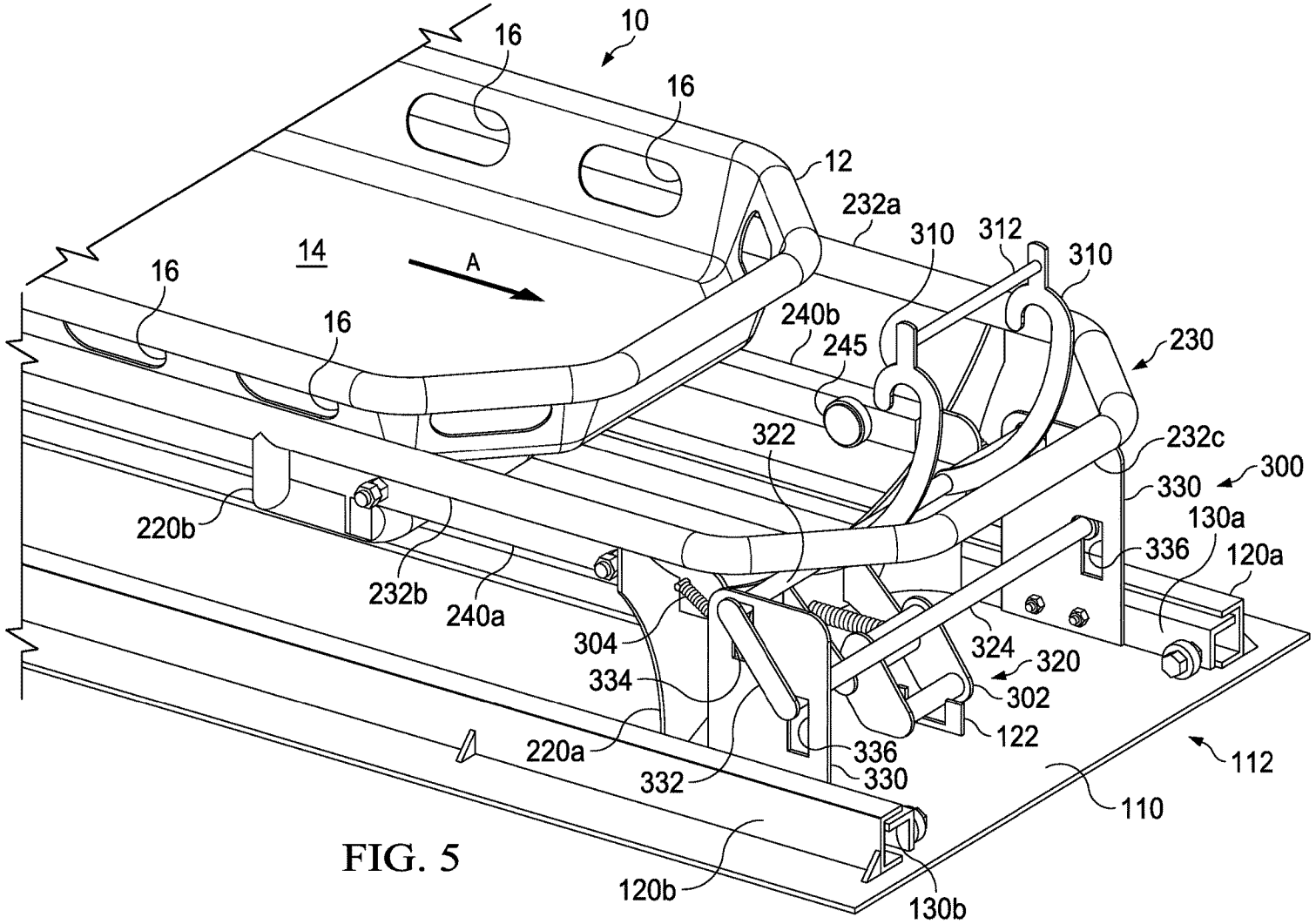
FIG. 5 shows a partial end perspective view of an exemplary embodiment of an extendable and retractable gurney according to the invention, depicting a rescue basket being moved into position on the gurney cradle, toward a basket clamp at the proximal end of the gurney.
Figure 6:
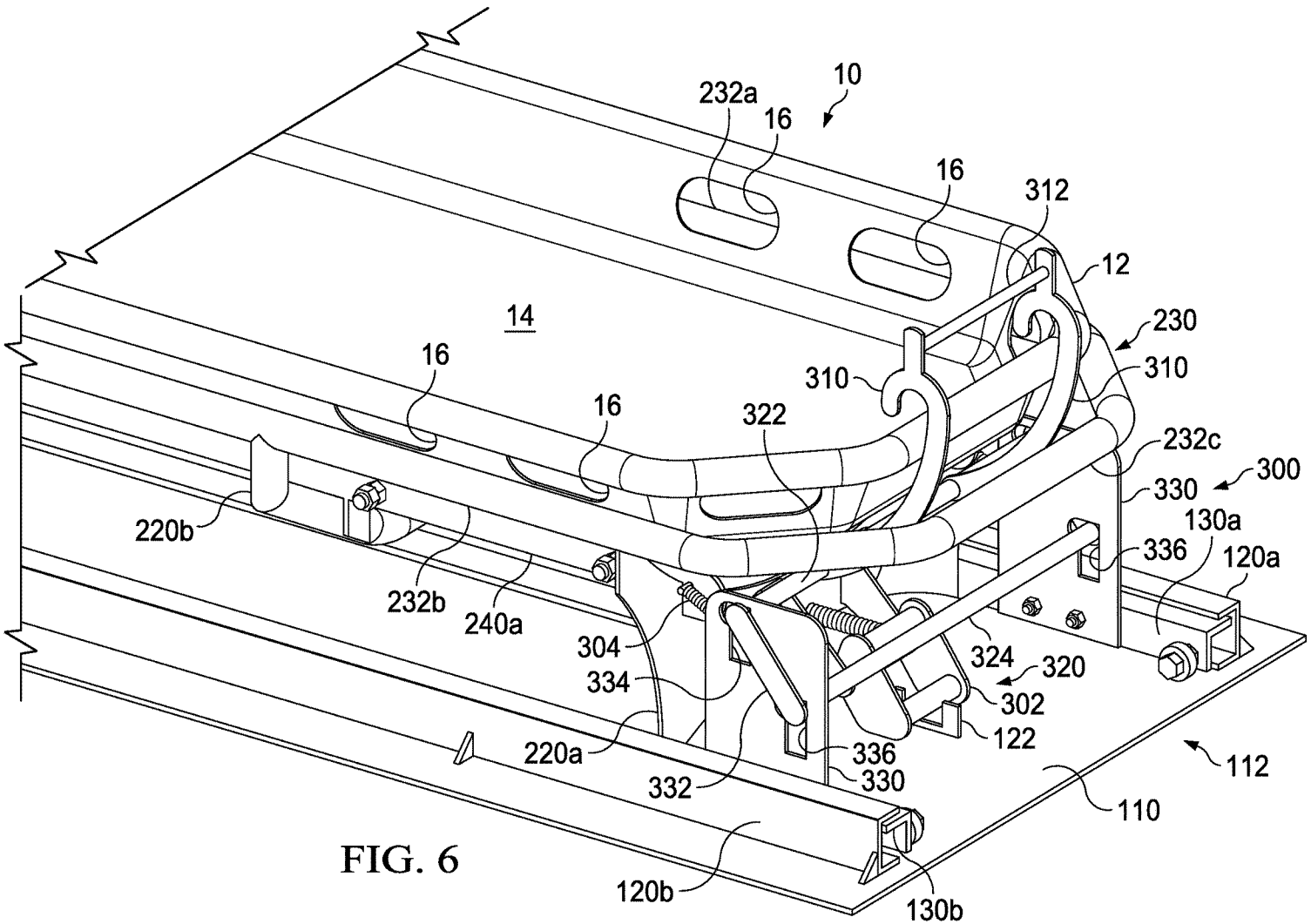
FIG. 6 follows from FIG. 5 and shows the rescue basket in position on the gurney cradle, with the basket clamp open to engage the proximal end of the basket.
Figure 7:
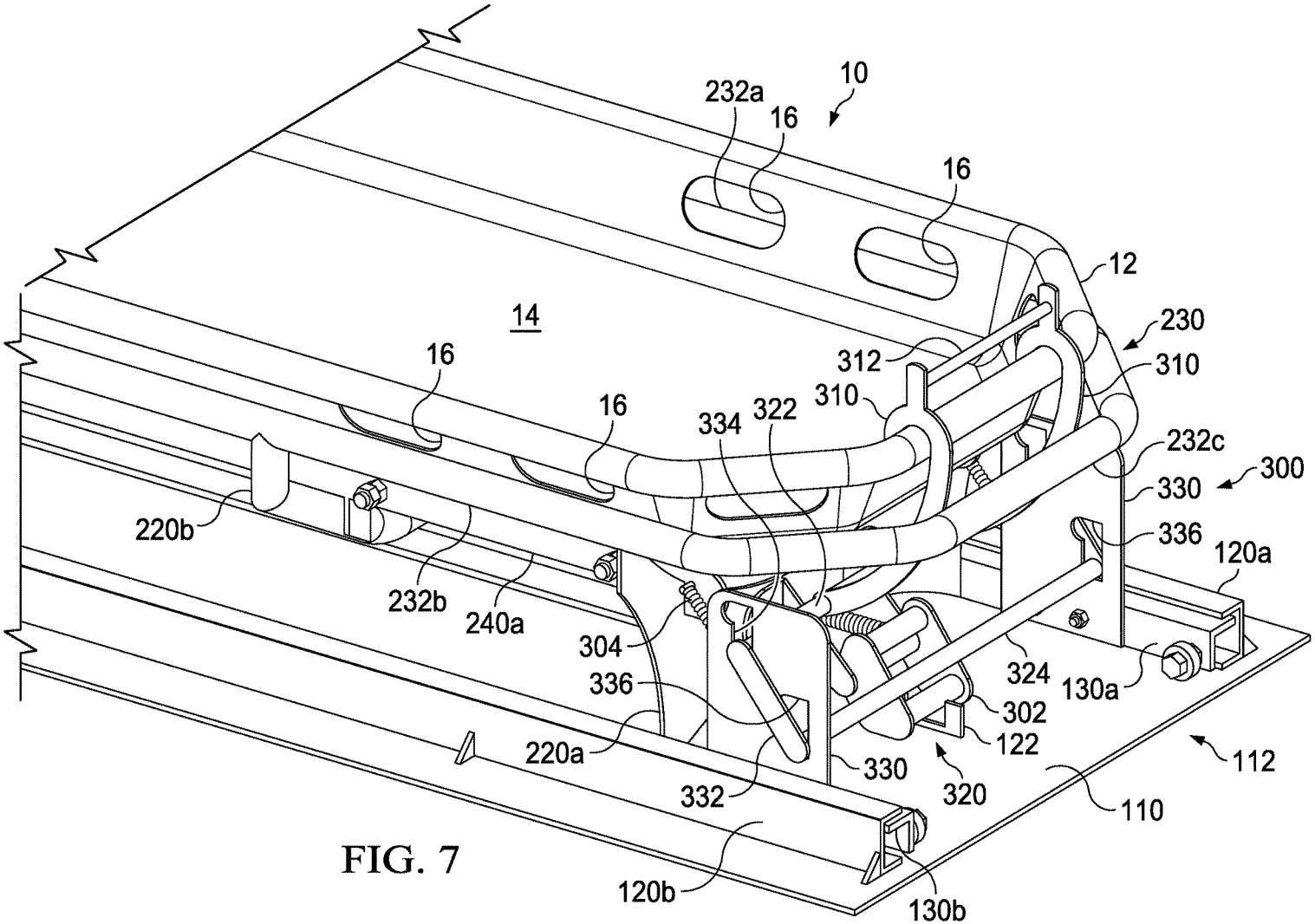
FIG. 7 follows from FIG. 6 and shows the rescue basket in position on the gurney cradle, with the basket clamp closed to engage the proximal end of the basket and restrain it in position on the gurney.

Referring now to FIGS. 5-7, these depict an exemplary proximal end of the extendable and retractable gurney with a clamp 300 to hold the rescue basket firmly in place on the extendable and retractable gurney 1000. While a variety of different clamping mechanisms may be used, the illustrated embodiment is spring-loaded, easy to use, and requires no additional structure to be able to clamp directly onto a frame 12 of a rescue basket.

The example of a clamp 300 shown includes a pair of spaced apart substantially vertical curvilinear claws 310 joined at the top by a lateral cross beam 310. The curvilinear claws 310 extend downward to a spring 304 and a pair of mechanical stop mechanisms (322, 324, 330, 334, 332, 336) spaced laterally apart from each other. The clamp 300 is initially in position shown in FIG. 5 which is the "open" position. When the rescue basket 10 is slid up in direction of arrow A by, for example gripping on hand holds 16 (with rescued party on the base 14), to touch the forward edges of the curvilinear claws 310, as in FIG. 6, the curvilinear claws 310 are still open. Upon urging the rescue basket further in direction A against the curvilinear claws 310, the curvilinear claws 310 move backward and down, as spring 304 assists in releasing the upper and lower lateral struts 322, 324 from engagement within the locking notches 334, 336 in the sides of brackets 330 to move to a lower position, as seen in FIG. 7. The clamp 300 at this point is firmly (but releasably) clamped to the end rail 12 of the rescue basket to lock it in position. The clamp 300 is easily released by gripping and lifting upward on lateral cross beam 312.

While examples of embodiments of the technology have been presented and described in text and some examples also by way of illustration, it will be appreciated that various changes and modifications may be made in the described technology without departing from the scope of the inventions, which are set forth in and only limited by the scope of the appended patent claims, as properly interpreted and construed.

The invention claimed is:

1. An extendable and retractable gurney, mountable to a rescue vehicle and configured to receive and hold a rescue basket thereon, the retractable gurney comprising:

a base comprising:

a base frame configured for mounting to a floor area of the rescue vehicle;

a longitudinal slider bracket fixedly mounted to the base frame, a slider operatively engaged with and sliding relative to the longitudinal slider bracket, from a stowed configuration to an extended configuration; and a rescue basket support frame mounted to the slider and above the base, the rescue basket support frame including:

a rescue basket cradle configured to support an end and sides of a rescue basket, the rescue basket cradle including a pair of parallel spaced apart longitudinal rescue basket side supports joined at a proximal end by a rescue basket end support;

a first series of rollers to facilitate rolling contact with an underside of a rescue basket placed on the extendable and retractable gurney to move the rescue basket longitudinally;

and a plurality of cross beams extending laterally between the pair of spaced apart longitudinal basket side supports such that, when in use, the rescue basket support frame slides on a second series of rollers.

2. The extendable and retractable gurney of claim 1, further comprising a longitudinally extending slat mounted at a lower elevation than, and extending inboard from, the pair of spaced apart longitudinal basket side supports, at least some of the first series of rollers arrayed alongside and extending at least partially above an upper surface of the slat.

3. The extendable and retractable gurney of claim 1, wherein the plurality of cross beams is convex-downward cross beams.

4. The extendable and retractable gurney of claim 1, further comprising a basket clamp, the basket clamp engaging an end portion of a frame of the rescue basket to lock the rescue basket in place on the rescue basket cradle.

5. The extendable and retractable gurney of claim 4, wherein the basket clamp is spring loaded and has a locking mechanism to secure the rescue basket.

6. The extendable and retractable gurney of claim 1, further comprising a mechanical lock having a hand grip at a distal end of the extendable and retractable gurney to mechanically lock the gurney in a stowed configuration or an extended configuration.

7. The extendable and retractable gurney of claim 2, further comprising a second slat parallel to the longitudinally extending slat, at least some of the first series of rollers arrayed alongside and extending at least partially above an upper surface of the second slat.

8. An extendable and retractable gurney mountable to a rescue vehicle and configured to receive and hold a rescue basket thereon, the retractable gurney comprising:

a base comprising:

a set of spaced apart longitudinal slider brackets fixedly mounted to a base frame, configured to attach to a floor area of a rescue vehicle;

a set of sliders; each slider of the set of sliders operatively engaged with and sliding relative to one of the set of longitudinal base supports from a stowed position to an extended position; and a rescue basket support frame mounted to the set of sliders and above the base, the rescue basket support frame including:

a rescue basket cradle configured to support an end and both sides of a rescue basket, the rescue basket cradle including a pair of spaced apart longitudinal rescue basket side supports joined by a rescue basket end support;

a first series of rollers arrayed to facilitate rolling contact between the series of rollers and an underside of a rescue basket, when a rescue basket is placed on the rescue basket cradle;

a plurality of cross beams configured to cradle and support a rescue basket thereon and extending laterally between the pair of spaced apart longitudinal basket side supports such that when in use the rescue basket support frame slides on a second series of rollers.

9. The extendable and retractable gurney of claim 8, further comprising a longitudinally extending slat mounted at a lower elevation than, and extending inboard from, the pair of spaced apart longitudinal basket side supports.

10. The extendable and retractable gurney of claim 9, further comprising a mechanical lock having a hand grip at a distal end of the extendable and retractable gurney to mechanically lock the gurney in a stowed configuration or an extended configuration.

11. The extendable and retractable gurney of claim 8, further comprising a basket clamp, the basket clamp engaging an end portion of a frame of the rescue basket to lock the rescue basket in place on the rescue basket cradle.

12. The extendable and retractable gurney of claim 11, wherein the basket clamp is spring loaded and has a locking mechanism to secure the rescue basket.

13. The extendable and retractable gurney of claim 10, wherein the mechanical lock is spring-loaded.

14. The extendable and retractable gurney of claim 9, further comprising a second slat parallel to the longitudinally extending slat, at least some of the first series of rollers arrayed alongside and extending at least partially above an upper surface of the second slat.

15. An extendable and retractable gurney configured to receive and hold a rescue basket thereon, the extendable and retractable gurney comprising:

a base configured for mounting to a floor area of a rescue vehicle, the base comprising a set of spaced apart longitudinal immobile slider brackets, and a corresponding set of sliders; each slider of the set operatively engaged with one of the set of longitudinal immobile slider brackets, and sliding from a stowed position to an extended position;

a rescue basket support frame including:

a rescue basket cradle configured to support an end and both sides of a rescue basket, the rescue basket cradle including a pair of spaced apart longitudinal basket side supports joined at their respective proximal ends to form a rescue basket end support;

a plurality of cross beams extending laterally between the pair of spaced apart longitudinal basket side supports, the cross beams mounted infixed mechanical relation to the sliders and configured to cradle and support a rescue basket thereon;

a pair of spaced apart parallel longitudinally extending slats mounted to the cross beams to extend at a lower elevation than, and inboard of, the pair of spaced apart longitudinal basket side supports; and a series of rollers arrayed along the pair of spaced apart parallel longitudinally extending slats, the rollers extending at least partially above upper surfaces of said slats.

16. The extendable and retractable gurney of claim 15, further comprising a mechanical lock having a hand grip at a distal end of the extendable and retractable gurney to mechanically lock the gurney in a stowed configuration or an extended configuration.

17. The extendable and retractable gurney of claim 16, wherein the mechanical lock is spring-loaded.

18. The extendable and retractable gurney of claim 15, further comprising a basket clamp, the basket clamp engaging an end portion of a frame of the rescue basket to lock the rescue basket in place on the rescue basket cradle.

19. The extendable and retractable gurney of claim 18, wherein the basket clamp is spring loaded and has a locking mechanism to secure the rescue basket.

20. The extendable and retractable gurney of claim 15, wherein the cross beams are convex downward.

* * * * *